US006205423B1

(12) United States Patent
Su et al.

(10) Patent No.: US 6,205,423 B1
(45) Date of Patent: Mar. 20, 2001

(54) METHOD FOR CODING SPEECH CONTAINING NOISE-LIKE SPEECH PERIODS AND/OR HAVING BACKGROUND NOISE

(75) Inventors: Huan-Yu Su, San Clemente; Eric Kwok Fung Yuen; Adil Benyassine, both of Irvine; Jes Thyssen, Laguna Niguel, all of CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/420,876

(22) Filed: Oct. 19, 1999

Related U.S. Application Data

(63) Continuation-in-part of application No. 09/006,422, filed on Jan. 13, 1998, now Pat. No. 6,104,994.

(51) Int. Cl.[7] ..... G10L 19/04

(52) U.S. Cl. ..... 704/233; 704/209; 704/219; 704/230; 704/220

(58) Field of Search ..... 704/219, 223, 704/233, 200, 230, 216, 217, 218, 209, 207, 220, 205, 206, 225

(56) References Cited

U.S. PATENT DOCUMENTS

| | | | | |
|---|---|---|---|---|
| 4,653,098 | * | 3/1987 | Nakata et al. | 704/207 |
| 5,276,765 | * | 1/1994 | Freeman et al. | 704/233 |
| 5,414,796 | * | 5/1995 | Jacobs et al. | 704/221 |
| 5,495,555 | * | 2/1996 | Swaminathan | 704/207 |
| 5,570,454 | * | 10/1996 | Liu | 704/223 |
| 5,732,392 | * | 3/1998 | Mizuno et al. | 704/233 |
| 5,809,453 | * | 9/1998 | Hunt | 704/214 |
| 5,915,234 | * | 6/1999 | Itoh | 704/219 |
| 6,104,994 | * | 8/2000 | Su et al. | 704/233 |

* cited by examiner

*Primary Examiner*—Richemond Dorvil
(74) *Attorney, Agent, or Firm*—Brinks, Hofer, Gilson & Lione

(57) ABSTRACT

A method of coding speech under background noise conditions or during noise-like speech periods wherein during active voice speech segments an analysis-by-synthesis method is used. However, when a background noise segment or noise-like speech segment is detected, an adaptive code book (pitch prediction) contribution is used as a source of a pseudo-random sequence in order to provide a better representation of the background noise or the noise-like speech. An improved gain quantization scheme is also employed when a background noise segment is detected, wherein energy of the total excitation with quantized gains is matched to the energy of total excitation with unquantized gains.

15 Claims, 5 Drawing Sheets

METHOD FOR CODING SPEECH CONTAINING NOISE-LIKE SPEECH PERIODS AND/OR HAVING BACKGROUND NOISE

REFERENCE TO RELATED APPLICATIONS

This Application is a continuation in part of application Ser. No. 09/006,422 filed Jan. 13, 1998 For Method For Speech Coding Under Background Noise Conditions, issued as U.S. Pat. No. 6,104,994.

BACKGROUND OF THE INVENTION

1. Field of the Invention

The present invention relates generally to the field of communications, and more specifically, to the field of coded speech communications.

2. Description of Related Art

During a conversation between two or more people, ambient background noise is typically inherent to the overall listening experience of the human ear. FIG. 1 illustrates the analog sound waves 100 of a typical recorded conversation that includes ambient background noise signal 102 along with speech groups 104–108 caused by voice communication. Within the technical field of transmitting, receiving, and storing speech communications, several different techniques exist for coding and decoding a signal 100. One of the techniques for coding and decoding a signal 100 is to use an analysis-by-synthesis coding system, which is well known to those skilled in the art.

FIG. 2 illustrates a general overview block diagram of a prior art analysis-by-synthesis system 200 for coding and decoding speech. An analysis-by-synthesis system 200 for coding and decoding signal 100 of FIG. 1 utilizes an analysis unit 204 along with a corresponding synthesis unit 222. The analysis unit 204 represents an analysis-by-synthesis type of speech coder, such as a code excited linear prediction (CELP) coder. A code excited linear prediction coder is one way of coding signal 100 at a medium or low bit rate in order to meet the constraints of communication networks and storage capacities. An example of a CELP based speech coder is the recently adopted International Telecommunication Union (ITU) G.729 standard, herein incorporated by reference.

In order to code speech, the microphone 206 of the analysis unit 204 receives the analog sound waves 100 of FIG. 1 as an input signal. The microphone 206 outputs the received analog sound waves 100 to the analog to digital (A/D) sampler circuit 208. The analog to digital sampler 208 converts the analog sound waves 100 into a sampled digital speech signal (sampled over discrete time periods) which is output to the linear prediction coefficients (LPC) extractor 210 and the pitch extractor 212 in order to retrieve the formant structure (or the spectral envelope) and the harmonic structure of the speech signal, respectively.

The formant structure corresponds to short-term correlation and the harmonic structure corresponds to long-term correlation. The short-term correlation can be described by time varying filters whose coefficients are the obtained linear prediction coefficients (LPC). The long-term correlation can also be described by time varying filters whose coefficients are obtained from the pitch extractor. Filtering the incoming speech signal with the LPC filter removes the short-term correlation and generates a LPC residual signal. This LPC residual signal is further processed by the pitch filter in order to remove the remaining long-term correlation. The obtained signal is the total residual signal. If this residual signal is passed through the inverse pitch and LPC filters (also called synthesis filters), the original speech signal is retrieved or synthesized. In the context of speech coding, this residual signal has to be quantized (coded) in order to reduce the bit rate. The quantized residual signal is called the excitation signal, which is passed through both the quantized pitch and LPC synthesis filters in order to produce a close replica of the original speech signal. In the context of analysis-by-synthesis CELP coding of speech, the quantized residual is obtained from a code book 214 normally called the fixed code book. This method is The fixed code book 214 of FIG. 2 contains a specific number of stored digital patterns, which are referred to as code vectors. The fixed code book 214 is normally searched in order to provide the best representative code vector to the residual signal in some perceptual fashion as known to those skilled in the art. The selected code vector is typically called the fixed excitation signal. After determining the best code vector that represents the residual signal, the fixed code book unit 214 also computes the gain factor of the fixed excitation signal. The next step is to pass the fixed excitation signal through the pitch synthesis filter. This is normally implemented using the adaptive code book search approach in order to determine the optimum pitch gain and lag in a "closed-loop" fashion as known to those skilled in the art. The "closed-loop" method, or analysis-by-synthesis, means that the signals to be matched are filtered. The optimum pitch gain and lag enable the generation of a so-called adaptive excitation signal. The determined gain factors for both the adaptive and fixed code book excitations are then quantized in a "closed-loop" fashion by the gain quantizer 216 using a look-up table with an index, which is a well known quantization scheme to those of ordinary skill in the art. The index of the best fixed excitation from the fixed code book 214 along with the indices of the quantized gains, pitch lag and LPC coefficients are then passed to the storage/transmitter unit 218.

The storage/transmitter 218 (of FIG. 2) of the analysis unit 204 then transmits to the synthesis unit 222, via the communication network 220, the index values of the pitch lag, pitch gain, linear prediction coefficients, the fixed excitation code vector, and the fixed excitation code vector gain which all represent the received analog sound waves signal 100. The synthesis unit 222 decodes the different parameters that it receives from the storage/transmitter 218 to obtain a synthesized speech signal. To enable people to hear the synthesized speech signal, the synthesis unit 222 outputs the synthesized speech signal to a speaker 224.

The analysis-by-synthesis system 200 described above with reference to FIG. 2 has been successfully employed to realize high quality speech coders. As can be appreciated by those skilled in the art, natural speech can be coded at very low bit rates with high quality. The high quality coding at a low-bit rate can be achieved by using a fixed excitation code book 214 whose code vectors have high sparsity (i.e., with few non-zero elements). For example, there are only four non-zero pulses per 5 ms in the ITU Recommendation G.729. However, when the speech is noise-like such as unvoiced speech or is corrupted by ambient background noise, the perceived performance of these coding systems is degraded. This degradation can be remedied only if the fixed code book 214 contains high-density non-zero pseudo-random code vectors and if the waveform-matching criterion in CELP systems is relaxed.

Sophisticated solutions including multi-mode coding and the use of mixed excitations have been proposed to improve the speech quality of noise-like speech such as unvoiced speech or speech under background noise conditions. However, these solutions usually lead to undesirably high complexity or high sensitivity to transmission errors. The present invention provides a simple solution to combat this problem.

SUMMARY OF THE INVENTION

The present invention includes a system and method to improve the quality of coded speech when ambient background noise is present or the speech segment is noise-like such as occurs during unvoiced speech. For most analysis-by-synthesis speech coders, the pitch prediction contribution is meant to represent the periodicity of the speech during voiced segments. One embodiment of the pitch predictor is in the form of an adaptive code book, which is well known to those of ordinary skill in the art. For background noise segments or noise-like speech, such as unvoiced speech, there is a poor or even non-existent long-term correlation for the pitch prediction contribution to represent. However, the pitch prediction contribution is rich in sample content and therefore represents a good source for a desired pseudo-random sequence which is more suitable for background noise coding or noise-like speech coding.

The present invention includes a classifier that distinguishes active portions of the input signal (active voice) from the inactive portions (background noise) of the input signal and/or noise like speech, such as unvoiced speech, portions. During active voice segments, the conventional analysis-by-synthesis system is invoked for coding. However, during background noise segments or noise-like speech, i.e. unvoiced speech, segments, the present invention uses the pitch prediction contribution as a source of a pseudo-random sequence determined by an appropriate method. The present invention also determines the appropriate gain factor for the pitch prediction contribution. Since the same pitch predictor unit and the corresponding gain quantizer unit are used for both active voice segments and background noise or noise-like speech segments, there is no need to change the synthesis unit. This implies that the format of the information transmitted from the analysis unit to the synthesis unit is always the same, which is less vulnerable to transmission errors.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

In the following detailed description of the present invention, a system and method to improve the quality of coded speech when ambient background noise or noise-like speech is present, numerous specific details are set forth in order to provide a thorough understanding of the present invention. However, it will be obvious to one of ordinary skill in the art that the present invention may be practiced without these specific details. In other instances, well know methods, procedures, components, and circuits have not been described in detail as not to unnecessarily obscure aspects of the present invention.

Figure 1:
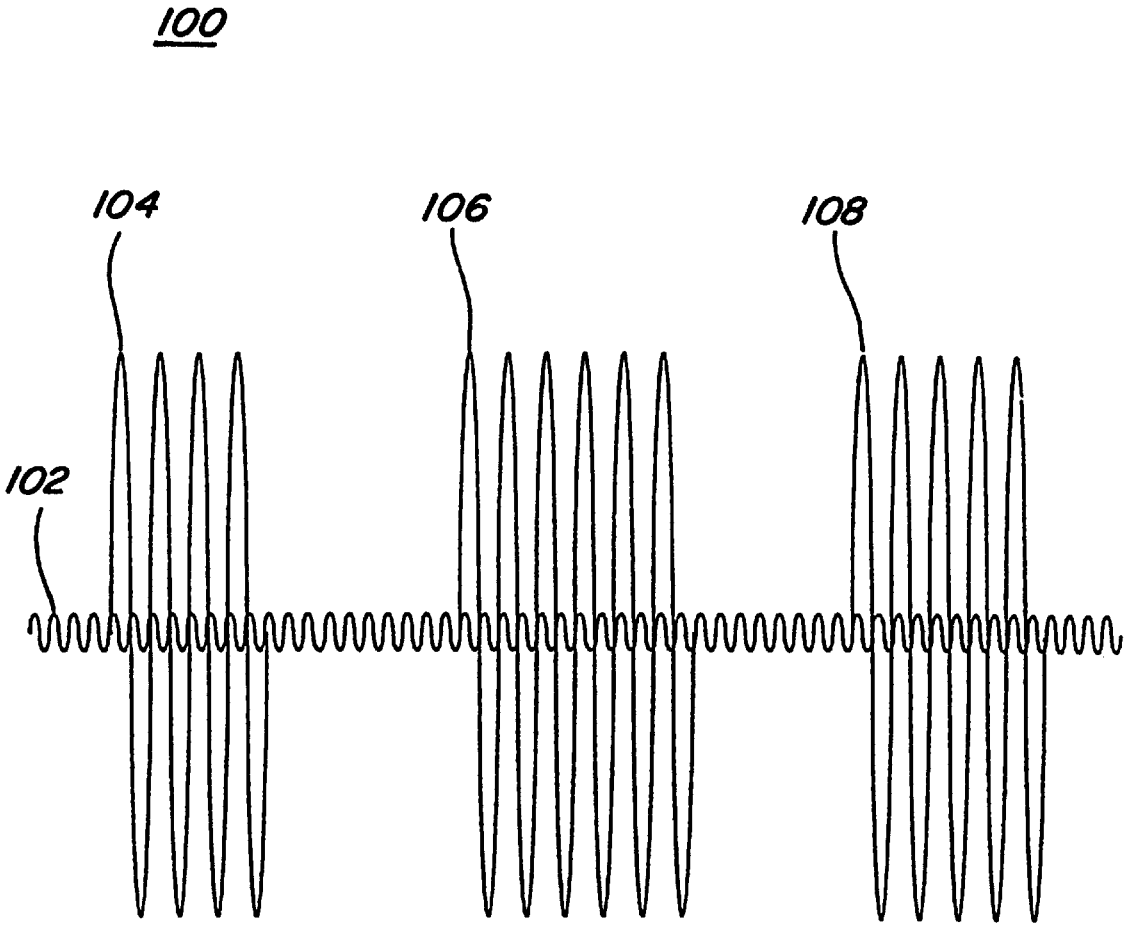
FIG. 1 PRIOR ART
FIG. 1 illustrates the analog sound waves of a typical speech conversation, which includes ambient background noise throughout the signal.
Figure 2:
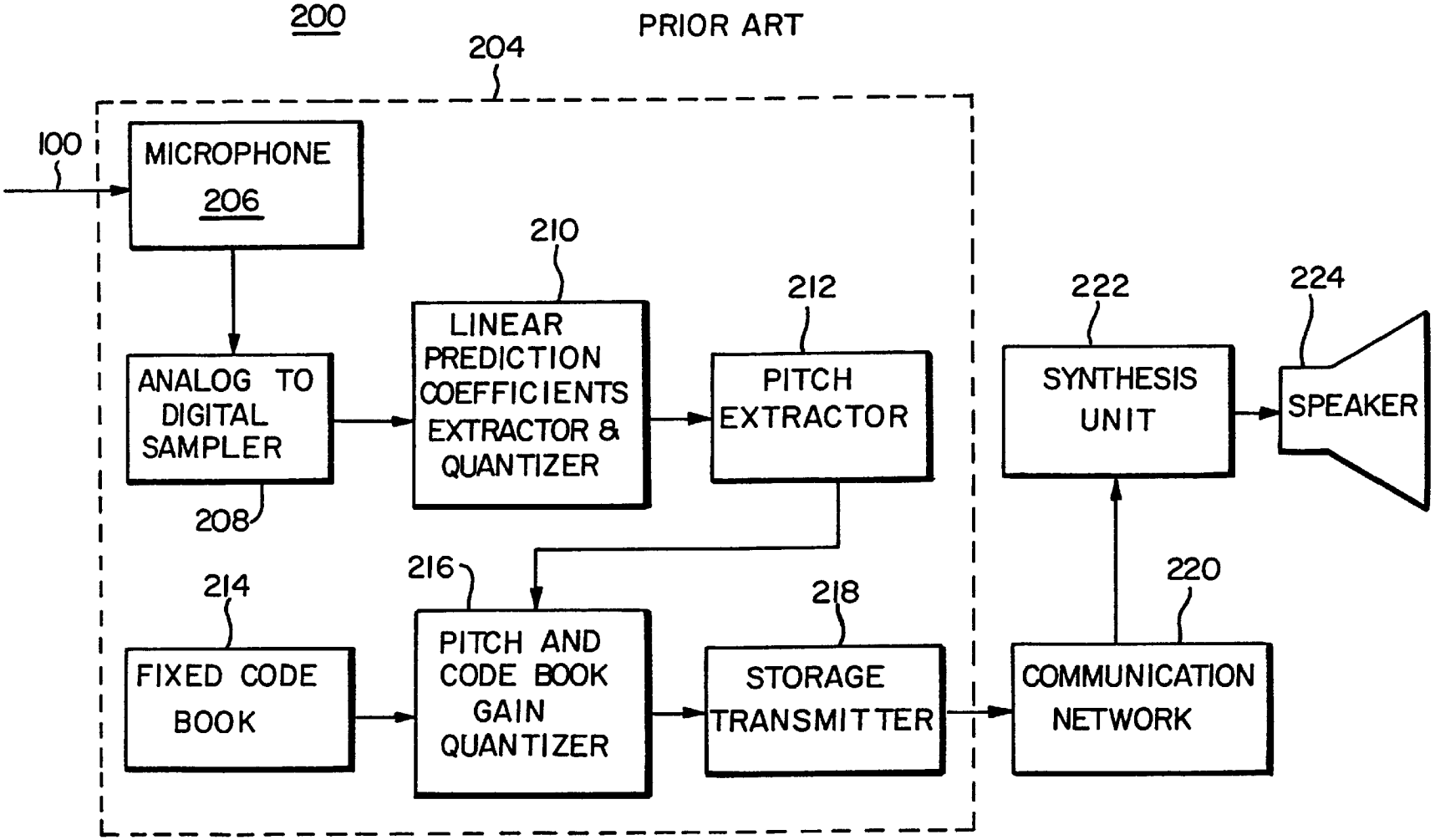
FIG. 2 PRIOR ART
FIG. 2 illustrates a general overview block diagram of a prior art analysis-by-synthesis system for coding and decoding speech.
Figure 3:
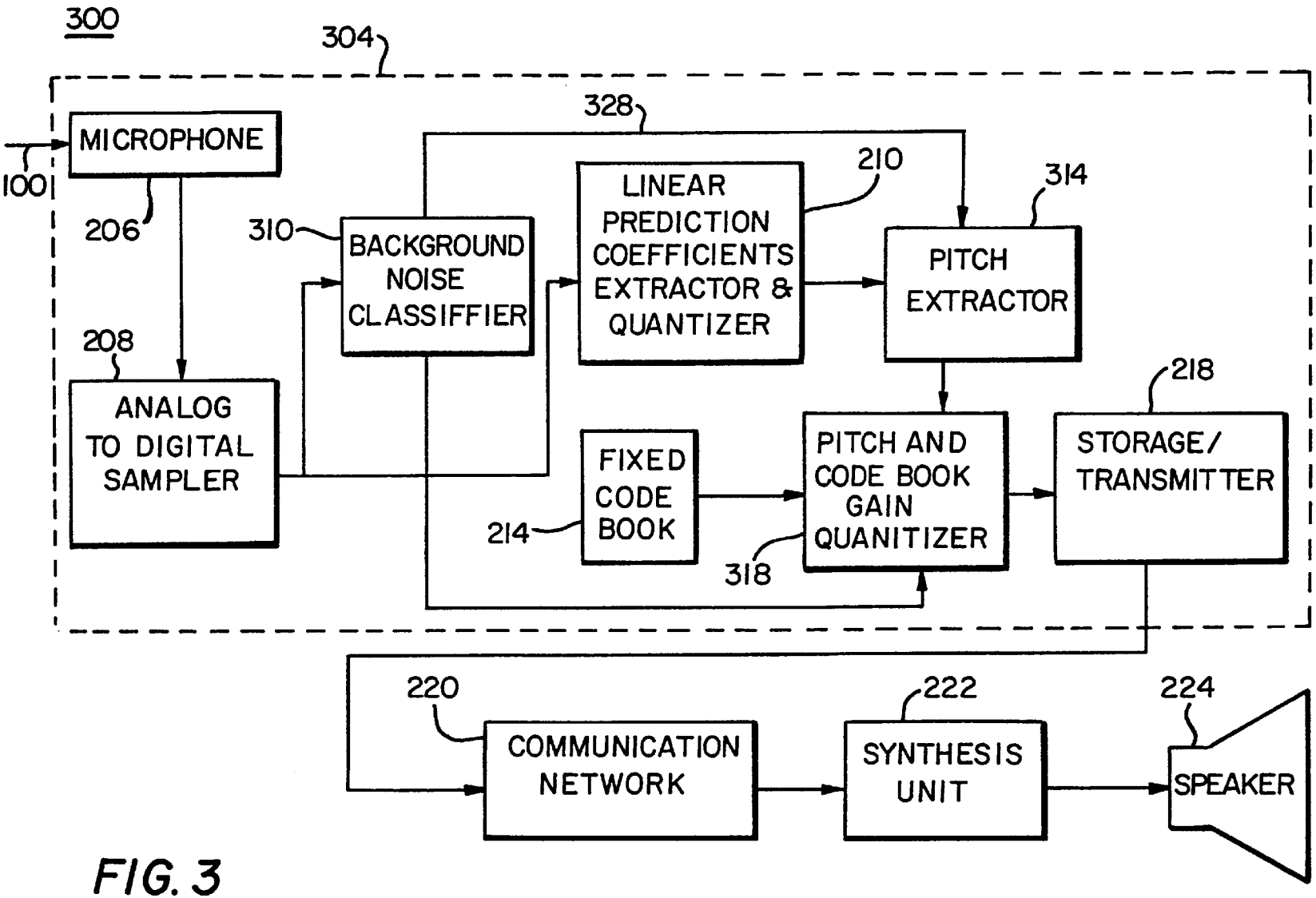
FIG. 3 illustrates a general overview of the analysis-by-synthesis system for coding and decoding speech in which the present invention operates.

The present invention operates within the field of coded speech communications. Specifically, FIG. 3 illustrates a general overview of the analysis-by-synthesis system 300 used for coding and decoding speech for communication and storage in which the present invention operates. The analysis unit 304 receives a conversation signal 100, which is a signal composed of representations of voice communication with background noise. Signal 100 is captured by the microphone 206 and then digitized into digital speech signal by the A/D sampler circuit 208. The digital speech is output to the classifier unit 310, and the LPC extractor 210.

The classifier unit 310 of FIG. 3 distinguishes the non-speech periods (e.g., periods of only background noise) or noise-like speech periods, such as unvoiced speech, contained within the input signal 100 from the active speech periods (see G.729 Annex B Recommendation which describes a voice activity detector (VAD), such as the classifier unit 310). Once the classifier unit 310 determines the non-speech or noise-like speech periods of the input signal 100, it transmits an indication to the pitch extractor 314 and the gain quantizer 318 as a signal 328. The pitch extractor 314 utilizes the signal 328 to best determine the pitch prediction contribution. The gain quantizer 318 utilizes the signal 328 to best quantize the gain factors for the pitch prediction contribution and the fixed code book contribution.

Figure 4:
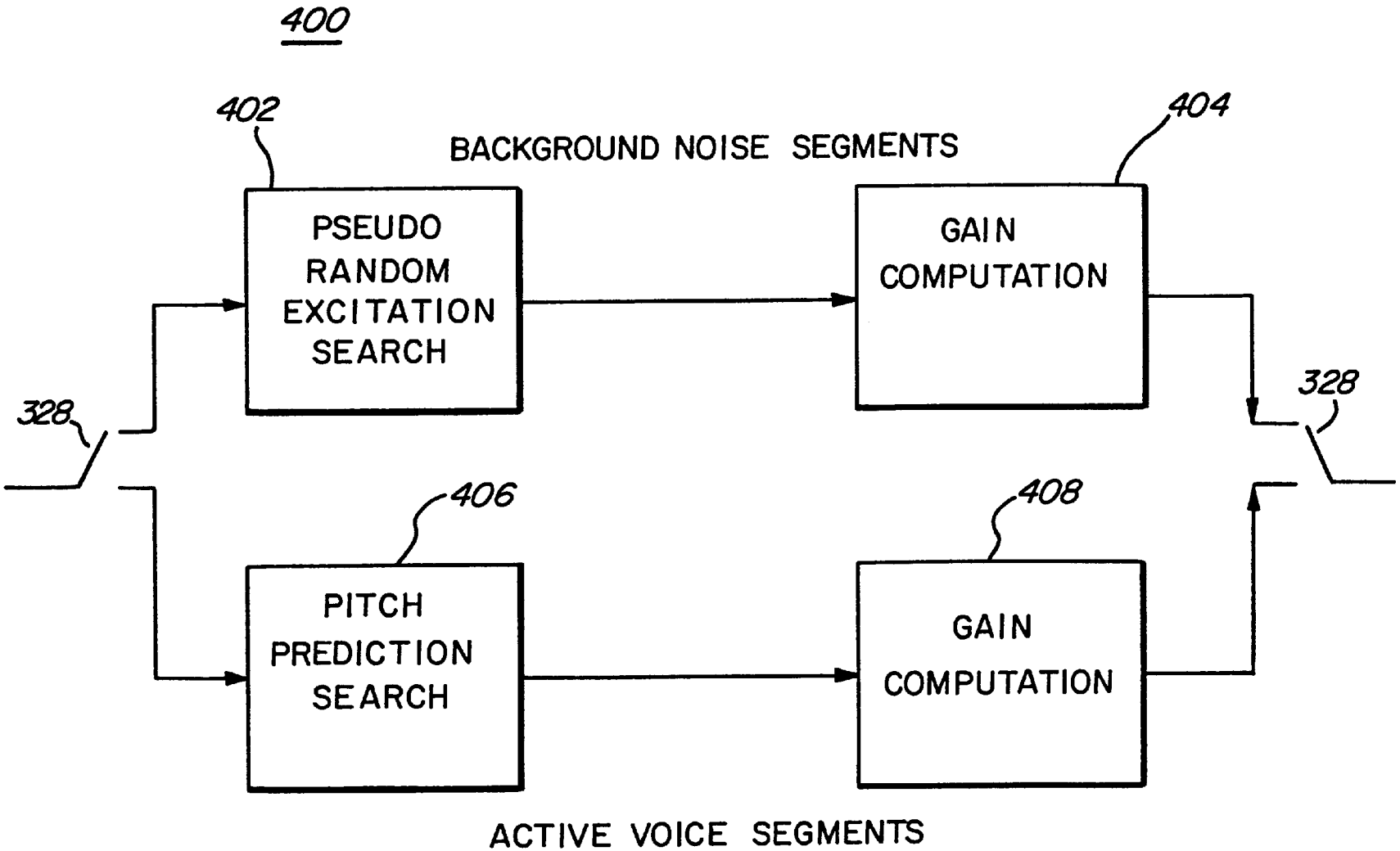
FIG. 4 illustrates a block diagram of one embodiment of a pitch extract unit in accordance with an embodiment of the present invention located within the analysis-by-synthesis system of FIG. 3.

FIG. 4 illustrates a block diagram of the pitch extractor 400, which is one embodiment of the pitch extractor unit 314 of FIG. 3 in accordance with an embodiment of the present invention. If the signal 328 (derived from the classifier unit 310) indicates that the current residual signal 330 is an active voice segment, the pitch prediction unit search 406 is used. Using the conventional analysis-by-synthesis method (see G.729 Recommendation for example), the pitch prediction unit 406 finds the pitch period of the current segment and generates a contribution based on the adaptive code book. The gain computation unit 408 then computes the corresponding gain factor.

If the signal 328 indicates that the current signal 330 is a background noise segment or noise-like speech segment, the code vector from the adaptive code residual book that best represents a pseudo-random excitation is selected by the excitation search unit 402 to be the contribution. In the embodiment, in order to choose the best code vector, the energy of the gain-scaled adaptive code book contribution is matched to the energy of the LPC residual signal 330. Specifically, an exhaustive search is used to determine the best index for the adaptive code book that minimize the following error criterion where L is the length of the code vectors:

$$\min_{index}\sum_{i=0}^{L-1}(residual(i)-G_{index}\times acb(i-index))^2$$

[Compare the above equation to equation (37) of the G.729 document:

$$R(k)=\frac{\sum_{n=0}^{39}x(n)y_k(n)}{\sqrt{\sum_{n=0}^{39}y_k(n)y_k(n)}}\ ]$$

This search is carried out in the excitation search unit 402, and then the adaptive code book gain (pitch gain) $G_{index}$ is computed in the gain computation block 404 as:

$$G_{index}=\sqrt{\frac{E_{res}}{E_{acb}}}\quad\text{where}$$

$$E_{res}=\sum_{i=0}^{L-1}residual(i)\times residual(i)$$

where *residual* is the signal 330

$$E_{acb}=\sum_{i=0}^{L-1}acb(i-index)\times acb(i-index)$$

where *acb* is the adaptive code book

[Compare with equation (43) of the G.729 document:

$$g_p=\frac{\sum_{n=0}^{39}x(n)y(n)}{\sqrt{\sum_{n=0}^{39}y(n)y(n)}},\quad\text{bounded by } 0\le g_p\le 1.2\ ]$$

The same adaptive code book is used for both active voice and background noise segments. Once the best index for the adaptive code book is found (pitch lag), the adaptive code book gain factor is determined as follows:

$$G_{\text{best_index}}=0.8\times\sqrt{\frac{E_{res}}{E_{acb}}}$$

$$E_{res}=\sum_{i=0}^{L-1}residual(i)\times residual(i)$$

$$E_{acb}=\sum_{i=0}^{L-1}acb(i-best_index)\times acb(i-best_index)$$

The value of $G_{best_index}$ is always positive and limited to have a maximum value of 0.5.

Once the pitch extractor unit 314 and the fixed code book unit 214 find the best pitch prediction contribution and the code book contribution respectively, their corresponding gain factors are quantized by the gain quantizer unit 318. For an active voice segment, the gain factors are quantized with the conventional analysis-by-synthesis method. For a background noise segment or noise-like speech segment, however, a different gain quantization method is needed in order to complement the benefit obtained by using the adaptive code book as a source of a pseudo-random sequence. However, this quantization technique may be used even if the pitch prediction contribution is derived using a conventional method. The following equations illustrate the quantization method of the present invention wherein the energy of the total excitation with quantized gains ($E_{cp}^{q}$) is matched to the energy of the total excitation with unquantized gains ($E_{cp}^{uq}$). Specifically, an exhaustive search is used to determine the quantized gains that minimize the following error criterion:

$$\min_{c,p}(E_{cp}^{uq}-E_{cp}^{q})^2$$

[This equation should be compared with equation (63) of the G.729 document:

$$E=x^tx+g_p^2y^ty+g_c^2z^tz-2g_px^ty-2g_cx^tz+2g_pg_cy^tz]$$

$$E_{cp}^{uq}=\sum_{i=0}^{L-1}(G_{acb}\times acb(i-best_index)+G_{codebook}\times codebook(i))^2$$

where $G_{acb}$ and $G_{codebook}$ are the unquantized optimal adaptive fixed code book and code book gain from units 314 and 214, respectively, acb(i–best_index) is the adaptive code book contribution, and code book(i) is the fixed code book contribution.

$$E_{cp}^{q}=\sum_{i=0}^{L-1}\left(\hat{G}_p\times acb(i-best_index)+\hat{G}_c\times codebook(i)\right)^2$$

where $\hat{G}_p$ and $\hat{G}_c$ are the quantified adaptive code book and the fixed code book gain, respectively.

The same gain quantizer unit 318 is used for both active voice and background noise segments.

Since the same adaptive code book and gain quantizer table are used for both active voice and background noise segments, the synthesis unit 222 remains unchanged. This implies that the format of the information transmitted from the analysis unit 304 to the synthesis unit 222 is always the same, which is less vulnerable to transmission errors compared to systems using multi-mode coding.

Figure 5A:
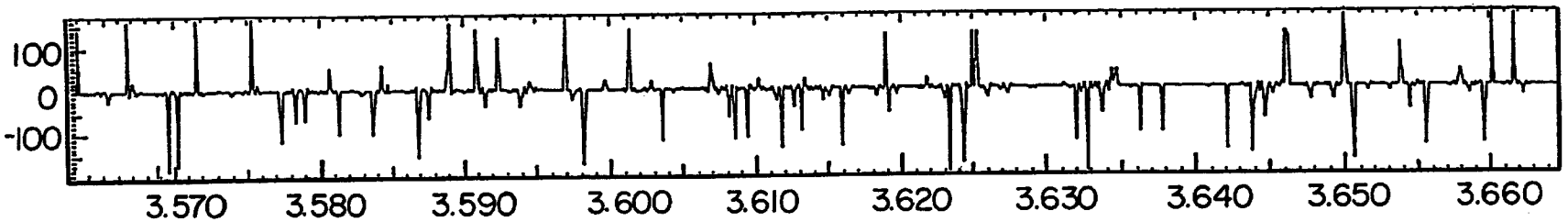
FIGS. 5(A) and 5(B) illustrate the combined gain-scaled adaptive code book and fixed excitation code book contribution for a typical background noise segment or noise-like speech segment, such as unvoiced speech.
Figure 5B:
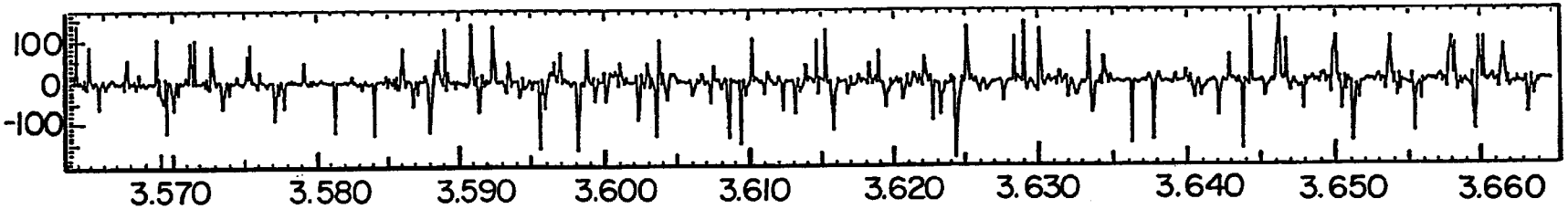

FIGS. 5(A) and 5(B) illustrate the combined gain-scaled adaptive code book and fixed excitation code book contribution. For a typical background noise segment or noise-like speech segment, the signal shown in FIG. 5(A) is the combined contribution generated by a conventional analysis-by-synthesis system. For the same background noise segment and noise-like speech segment, the signal shown in FIG. 5(B) is the combined contribution generated by the present invention. It is apparent that signal in FIG. 5(B) is richer in sample content than the signal in FIG. 5(A). Hence, the quality of the synthesized background noise or noise-like speech is perceptually better when using the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method for coding speech under background noise conditions, the method comprising the steps of:

digitizing a speech containing input signal having speech periods and non-speech periods;

distinguishing the non-speech periods from the speech periods in the digitized input signal;

determining a pitch predication contribution for each speech period;

using an adaptive code book as a source of pseudo-random sequences; and selecting the most suitable pseudo-random sequence for each non-speech period from the adaptive code book.

2. The method of claim 1 further comprising the step of determining linear prediction coefficients (LPC) and an LPC residual signal of the digitized input signal.

3. The method of claim 2 wherein the linear prediction coefficients are used to select the pseudo-random sequence from the adaptive code book.

4. The method of claim 2 further comprising the step of computing an adaptive code book gain factor for each non-speech period by matching the LPC residual signal with a gain-scaled adaptive code book contribution.

5. The method of claim 4 further comprising the step of quantizing a fixed code book gain factor and an adaptive code book gain factor by matching energy of a total excitation with quantized gains to energy of total excitation with unquantized gains.

6. A method for coding speech containing nose-like speech periods, the method comprising the steps of:

digitizing a speech containing input signal having noise-like speech periods, speech periods, and non-speech periods;

distinguishing the non-speech periods and noise-like speech periods from the speech periods in the digitized input signal;

determining a pitch prediction contribution for each speech period;

using an adaptive code book as a source of pseudo-random sequences; and selecting the most suitable pseudo-random sequence for each non-speech period and noise-like speech period from the adaptive code book.

7. The method of claim 6 further comprising the step of determining linear prediction coefficients (LPC) and an LPC residual signal of the digitized input signal.

8. The method of claim 7 wherein the linear prediction coefficients are used to select the pseudo-random sequence from the adaptive code book.

9. The method of claim 7 further comprising the step of computing an adaptive code book gain factor for each non-speech period or nose-like speech period by matching the LPC residual signal with a gain-scaled adaptive code book contribution.

10. The method of claim 9 further comprising the step of quantizing a fixed code book gain factor and an adaptive code book gain factor by matching energy of a total excitation with quantized gains to energy of total excitation with unquantized gains.

11. A method for coding speech containing noise-like speech periods, the method comprising the steps of:

digitizing a speech containing input signal having noise-like speech periods and speech periods;

distinguishing the noise-like speech periods from the speech periods in the digitized input signal;

determining a pitch predictor contribution for each speech period;

using an adaptive code book as a source of pseudo-random sequences; and selecting the most suitable pseudo-random sequence for each noise-like speech period from the adaptive code book.

12. The method of claim 11 further comprising the step of determining linear prediction coefficients (LPC) and an LPC residual signal of the digital in put signal.

13. The method of claim 12 wherein the linear predication coefficients are used to select the pseudo-random sequence from the adaptive code book.

14. The method of claim 12 further comprising the step of computing an adaptive code book gain factor for each noise-like speech period by matching the LPC residual signal with a gain-scaled adaptive code book contribution.

15. The method of claim 14 further comprising the step of quantizing a fixed code book gain factor and an adaptive code book gain factor by matching energy of total excitation with quantized gains to energy of total excitation with unquantized gains.

* * * * *

UNITED STATES PATENT AND TRADEMARK OFFICE

CERTIFICATE OF CORRECTION

PATENT NO. : 6,205,423 B1
DATED : March 20, 2001
INVENTOR(S) : Su et al.

It is certified that error appears in the above-identified patent and that said Letters Patent is hereby corrected as shown below:

Column 7,
Line 12, replace “predication” with -- prediction --.

Column 8,
Line 35, replace “predication” with -- prediction --.

Signed and Sealed this

Seventh Day of February, 2006

JON W. DUDAS
*Director of the United States Patent and Trademark Office*